US005367121A

United States Patent [19]

Yanase

[11] Patent Number: 5,367,121

[45] Date of Patent: Nov. 22, 1994

[54] ELECTRONIC MUSICAL INSTRUMENT WITH MINUS-ONE PERFORMANCE FUNCTION RESPONSIVE TO KEYBOARD PLAY

[75] Inventor: Tsutomu Yanase, Hamamatsu, Japan

[73] Assignee: Yamaha Corporation, Hamamatsu, Japan

[21] Appl. No.: 630

[22] Filed: Jan. 5, 1993

[30] Foreign Application Priority Data

Jan. 8, 1992 [JP] Japan ..... 4-001631

[51] Int. Cl.[5] ..... G10H 1/36

[52] U.S. Cl. ..... 84/666

[58] Field of Search ..... 84/609–614, 84/634–638, 649–652, 666–669

[56] References Cited

U.S. PATENT DOCUMENTS 5,189,237 2/1993 Koguchi ..... 84/609

5,235,125 8/1993 Sato et al. ..... 84/609

FOREIGN PATENT DOCUMENTS 1321480 12/1989 Japan .

*Primary Examiner*—Stanley J. Witkowski

*Attorney, Agent, or Firm*—Spensley Horn Jubas & Lubitz

[57] ABSTRACT

An electronic musical instrument has a minus-one function to effect switching between full automatic performance and semi-automatic performance in which programmed musical tones are generated as automatic accompaniment except for melody and obbligato parts. A performance data memory records automatic performance data. A keyboard has a right key region allotted with the melody part and a left key region allotted with the obbligato part. A CPU controls the automatic performance according to operation of various switches including a song selecting switch, a start/stop switch and a minus-one switch for setting the minus-one mode. Under the minus-one mode of the automatic performance, instant musical tones are generated in response to the operation of the keyboard, while corresponding programmed musical tones are inhibited for the melody and obbligato parts when the key operation is detected on either of the right and left key regions.

15 Claims, 11 Drawing Sheets

ELECTRONIC MUSICAL INSTRUMENT WITH MINUS-ONE PERFORMANCE FUNCTION RESPONSIVE TO KEYBOARD PLAY

BACKGROUND OF THE INVENTION

The present invention relates to an electronic musical instrument with automatic performance function, constructed not only to generate a musical sound in response to operation of an input implement such as a keyboard, but also to undergo automatic performance of a given musical composition composed of plural parts according to performance data recorded in a memory.

In some conventional electronic musical instruments having automatic performance function, a semi-automatic performance can be effected to selectively silence a certain one of the plural parts of the musical composition, while a player conducts a manual performance of the silenced part in synchronization with the remaining sounded parts. By such operation, automatic performance of a rather mechanical nature may be modified to add a human touch. Further, in practicing a certain part, the player can readily recognize if the certain part is actually mastered without notes. Such a technique of selectively silencing a desired part of the automatic performance is called "minus-one performance" or "minus play". This technique is disclosed, for example, in Japanese Patent Application Laid-Open No. 321480/1989. In this prior art, a specific switch is provided to select a particular part of the performance data corresponding to one of upper, lower and foot keyboards to effect the minus-one performance.

However, the conventional electronic musical instrument utilizes a function selecting switch to change between the minus-one performance and the regular or full automatic performance. Therefore, once the minus-one performance is selected and set, a certain part designated in minus play is continuously held in a silenced state. The conventional instrument is at a disadvantage in that the function selecting switch must be actuated during the course of the minus-one performance in order to recover the silenced state of the designated part. For instance, when practicing the designated part using the minus-one performance, if the player incidentally wants to hear the designated part, due to lack of score memory for example, the player must actuate the function selecting switch to restore the designated part immediately after incidental play discontinuation of the designated part.

SUMMARY OF THE INVENTION

An object of the invention is to improve operability and efficiency of the minus-one function in the electronic musical instrument of the type having an input implement such as a keyboard for use in manual performance, and having automatic performance function to effect automatic performance of a given musical composition composed of plural parts. In order to achieve the object, the electronic musical instrument having automatic performance function includes an input implement operable to input manual performance information, detecting means for detecting if the input implement is operated, and musical tone generating means receptive of the manual performance information from the input implement for generating instant musical tones accordingly. The instrument also includes automatic performance means for feeding automatic performance information of a given musical composition composed of plural parts to the musical tone generating means to generate programmed musical tones accordingly, allotting means for allotting a particular one of the plural parts of the given musical composition to the input implement, and minus control means operative when the detecting means detects operation of the input implement for controlling the musical tone generating means to inhibit generation of programmed musical tones of the particular part while allowing generation of instant musical tones for the same part.

According to the invention, when the manual performance information is inputted by means of the input implement, such as a keyboard into the electronic musical instrument having the automatic performance function, the musical tone generating means generates the instant musical tones according to the inputted manual performance information. Concurrently, the automatic performance means enables the musical tone generating means to generate programmed musical tones of the plural parts according to the automatic performance information. In this operation, the minus control means controls the musical tone generating means in response to the operation of the input implement for inhibiting generation partly of the programmed musical tones for the particular part which is allotted to the input implement.

DETAILED DESCRIPTION OF THE INVENTION

Figure 1:
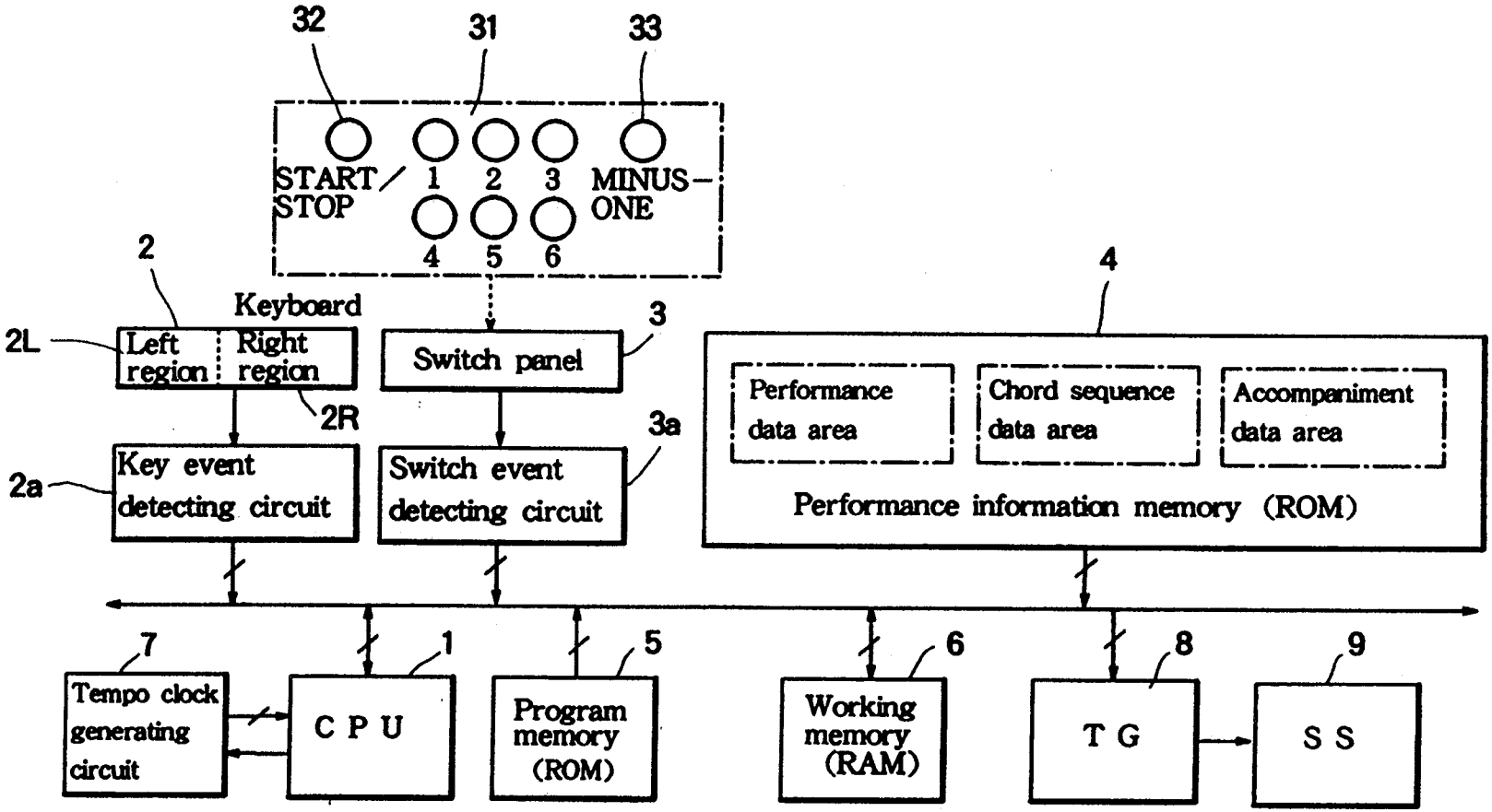
FIG. 1 is a block diagram showing one embodiment of the inventive electronic musical instrument having automatic performance function.

FIG. 1 is a block diagram showing one embodiment of the inventive electronic musical instrument. The electronic musical instrument is controlled by a CPU 1 to effect either manual or keyboard performance and automatic performance by operation of a keyboard 2 and a switch panel 3. The automatic performance can be effected for a selected musical composition composed of plural parts. This embodiment has minus-one function with respect to a melody part and an obbligato part. A key event detecting circuit 2*a* is provided to detect a key event on the keyboard 2 to output a key code corresponding to a key-on event, together with a key-on signal indicative of key depression or a key-off signal indicative of key release. The keyboard 2 is divided into a right region 2R and a left region 2L, which regions are allotted with different parts in the minus-one function. The switch panel 3 includes various switches such as a song selecting switch 31 for selecting a desired one of plural musical compositions recorded for the automatic performance (hereinafter, each of the recorded musical compositions is called "song"), a start/stop switch 32 for commanding start and stop of the automatic performance, and a minus-one switch 33 for setting the minus-one mode. A switch event detecting circuit 3*a* is provided to detect a switch event on the switch panel 3 to produce a signal corresponding to an actuated switch.

A performance information memory 4 of ROM type stores various data needed for automatic performance including automatic accompaniment. The memory 4 contains an accompaniment data area, a chord sequence data area and a performance data area. The first accompaniment data area is recorded with automatic accompaniment patterns such as a bass performance pattern and a chord backing pattern for each song. These accompaniment patterns are repeatedly read out with progression of song performance. The second chord sequence data area is recorded with a chord data progression throughout the entire length of each song. The chord data is continuously read out along with progression of song performance. The accompaniment pattern is tuned according to the read chord data to effect the automatic accompaniment. Such a type of the automatic accompaniment is called "chord sequencer method". The third performance data area is recorded with note data sequence throughout the entire length of each song for non-repetitive parts such as a melody part, an obbligato part and occasionally a bass part, depending on the nature of the song. The note data is continuously read out in the progression of song performance. For simplicity, the note data sequence is prepared for only the melody and obbligato parts in this embodiment.

Figure 2:
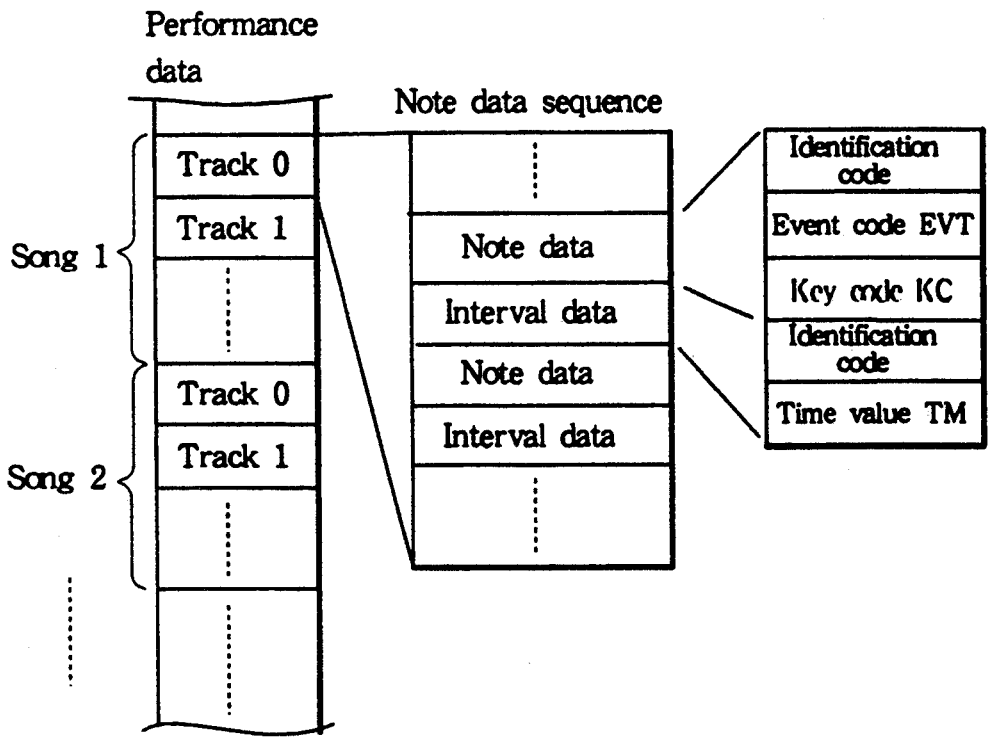
FIG. 2 is a schematic diagram showing a recorded format of performance data in the embodiment.

FIG. 2 shows a record format of the note data sequence. The performance data of each song (song 1, song 2, . . . ) is comprised of track 0 and track 1 corresponding to the melody part and the obbligato part, respectively. The respective track is composed of a sequence of note data corresponding to note-on/note-off events and interval data indicative of a time interval between adjacent note events. Each note data is comprised of an identification code thereof, an event code EVT indicative of key-on or key-off, and a key code KC corresponding to a particular key-on event. Each interval data is comprised of an identification code thereof and an interval time value TM in terms of a number of tempo clocks. Further, an address pointer is provided for the respective tracks to read out the note data sequence. The address pointer is updated whenever a unit of note data and a unit of interval data are retrieved.

Returning to FIG. 1, a program memory 5 of ROM type stores a given control program shown in flow charts of FIGS. 3–11. The CPU 1 controls based on the control program stored in the program memory 5 using various registers, counters and flags provided in a working memory 6 of RAM type. A tempo clock generating circuit 7 generates a tempo clock at every timing of one-eighth beat (one beat corresponds to a quarter note) according to a tempo value set by the CPU 1. The CPU 1 executes an interruption process in response to each tempo clock to control programmed tone generation of the automatic performance. A tone generator (TG) 8 has a plurality of sound channels. The CPU 1 assigns musical tone data to these sound channels of the tone generator 8 to effect tone generation. The tone generator 8 reads out a waveform data of a given timbre from a musical tone waveform memory (not shown) according to the tone data fed from the CPU 1 to output to a sound system (SS) 9 a musical tone signal having a given tone pitch determined by the inputted tone data. The sound system 9 carries out D/A conversion and amplification of the musical tone signal to generate musical tones. In this embodiment, there are set different rhythm patterns of four-quarter measure and three-quarter measure according to the kinds of songs to be automatically performed, i.e., according to song codes SNG. A clock number of one measure is determined by a flag BT (SNG) which uses SNG as an index.

Figure 3:
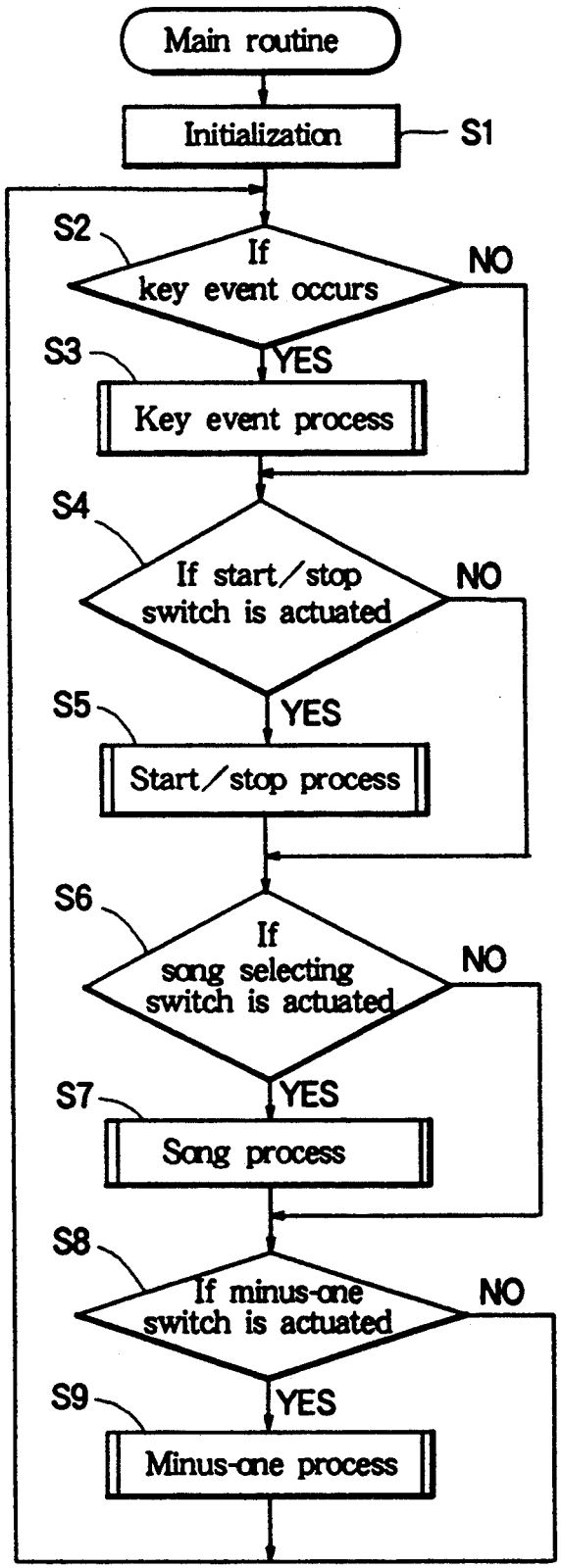
FIG. 3 is a flow chart showing a main routine of control for the embodiment.

Next, operation of this embodiment will be described in conjunction with flow charts of FIGS. 3–11, where FIG. 3 shows a main routine of the control program, and FIGS. 4–11 show subroutines and interruption routines. In the following description and the flow charts, various registers, counters and flags used in the controlling are denoted by the following labels; and their contents or values are also represented by the same labels unless, otherwise specified.

- RUN: a run flag indicative of start/stop state of the automatic performance
- MUT: a flag indicative of set state of the minus-one mode
- $INT_0$: a counter for counting time value TM of the melody interval data
- $INT_1$: a counter for counting time value TM of the obbligato interval data
- CLK: a counter for counting a tempo clock of the automatic performance within one measure
- SNG: a register for registering a song code selected in the automatic performance
- BT(k): a flag memorizing a time measure of the song designated by a song code SNG=k Referring first to FIG. 3, a power source is switched on so that the CPU 1 initiates the main routine. Step S1 carries out initialization so that respective flags, counters and registers are reset and the tempo clock generating circuit 7 is preset with a given tempo value. Next, Step S2 checks if a key event has occurred. Step S4 is initiated if no key event occurred. On the other hand, if there is a key event, Step S3 carries the "key event process" of FIG. 4, thereby proceeding to Step S4. Step S4 checks whether the start/stop switch 32 is actuated. Step S6 is carried out if the start/stop switch is not actuated. On the other hand, if there is actuation of the start/stop switch, Step S5 carries out the "start/stop process" of FIG. 5, thereby proceeding to Step S6. Step S6 checks if the song selecting switch 31 is actuated. Step S8 is carried out if no switch actuation occurred. On the other hand, if there is switch actuation, Step S7 carries out the "Song process" of FIG. 6, thereby proceeding to Step S8. Step S8 checks if the minus-one switch 33 is actuated. If no switch actuation occurred, processing returns to Step S2 to repeat subsequent steps. On the other hand, if there is switch actuation, Step S9 carries out the "Minus-one process" of FIG. 7, thereby returning to Step S2 to repeat subsequent steps.

Figure 4:
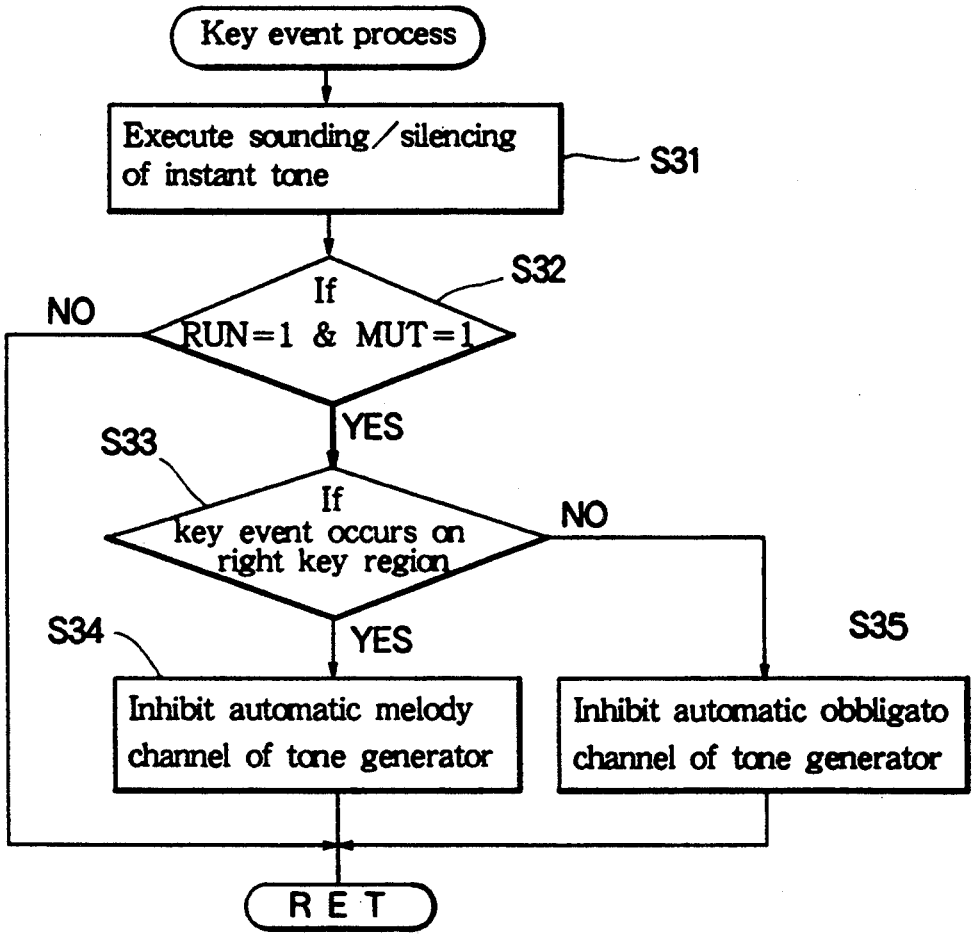
FIG. 4 is a flow chart showing a key event process in the embodiment.

In the key event process shown in FIG. 4, Step S31 executes either sounding silencing of an instant tone, depending on key depression or key release. Then, Step S32 determines if the condition RUN=1 and MUT=1 is held. In this regard, the flag RUN is set with value "1" by the start/stop process (described later in detail) under the running state of the automatic performance. Alternatively, the flag RUN is set with the value "0" under the stopped state of the automatic performance. The flag MUT is set with the value "1" by the minus-one process upon selection of the minus-one mode, and is set with the value "0" upon release of the minus-one mode. If it is found that the above condition is not satisfied in Step S32, processing returns to the main routine since the minus-one mode is not established during the automatic performance. If the condition is satisfied, processing proceeds to Step S33 since the minus-one mode is established in the automatic performance. Step S33 checks whether the key event occurs in the right key region 2R. If the key event occurs on the right key region 2R, Step S34 inhibits a particular sound channel of the tone generator 8, which is assigned with the melody part of the automatic performance, thereafter returning to the main routine. On the other hand, if the key event occurs in the left key region 2L, Step S35 inhibits a particular sound channel of the tone generator 8, which is assigned with the obbligato part of the automatic performance, thereafter returning to the main routine. In this regard, a key-off signal is fed to the particular sound channel and forced dumping is effected to inhibit and silence the particular sound channel. By the above-described key event process, when the minus-one mode is set during the course of the automatic performance, the operator can play the keyboard 2 to accomplish manual performance to generate instant melody or obbligato tones, while the melody part of the automatic performance is suppressed when the right key region 2R is manipulated or the obbligato part of the automatic performance is suppressed when the left key region 2L is manipulated.

Figure 5:
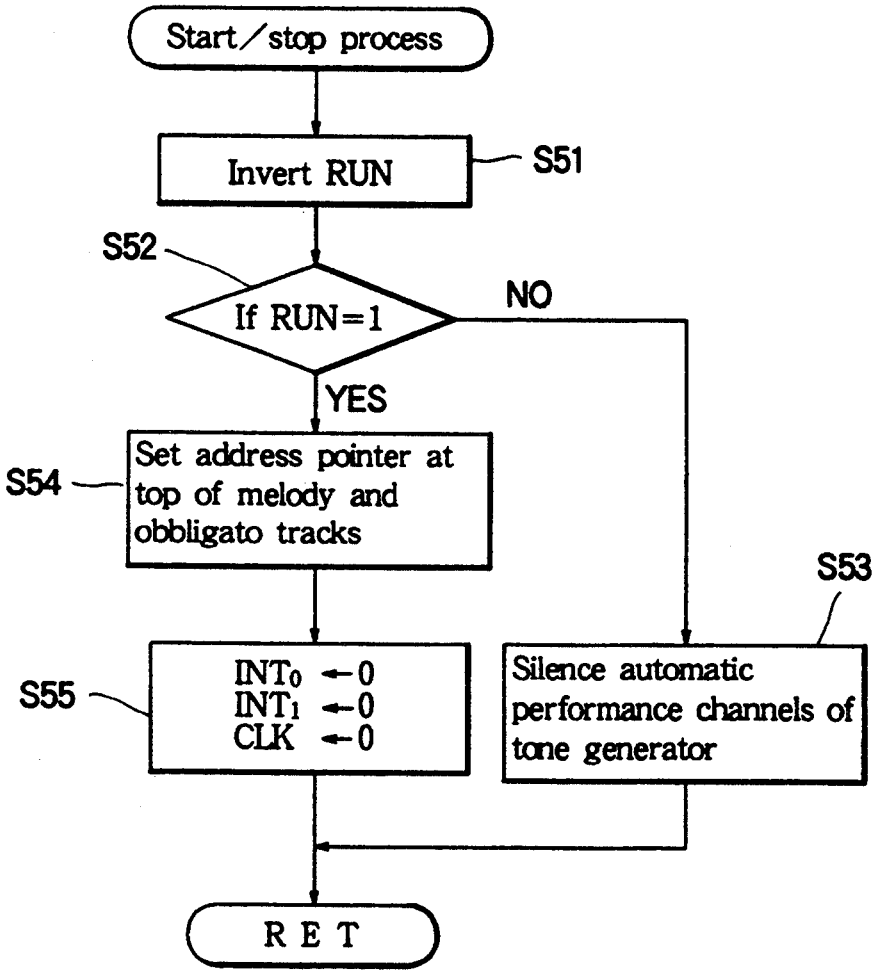
FIG. 5 is a flow chart showing a start/stop process in the embodiment.

In the start/stop process shown in FIG. 5, the flag RUN is inverted by actuation of the start/stop switch in Step S51. Then, subsequent Step S52 checks if RUN=1. If RUN=1 is not held, i.e., if RUN=0, a stop command is inputted during the running state of the automatic performance. Then all the sound channels of the tone generator 8 assigned to the automatic performance are placed in a silent state in Step S53, thereby returning to the main routine. On the other hand, if RUN=1 is held in Step S52, a start command of the automatic performance is inputted so that respective address pointers are set to the top of the melody track and the obbligato track of the note data sequence recorded for the currently selected song, in Step S54. Then in Step S55, the counters $INT_0$, $INT_1$ and CLK are all reset to "0", thereafter returning to the main routine. After this inversion to RUN=1, the tempo clock interruption process is periodically called to conduct the automatic performance.

Figure 6:
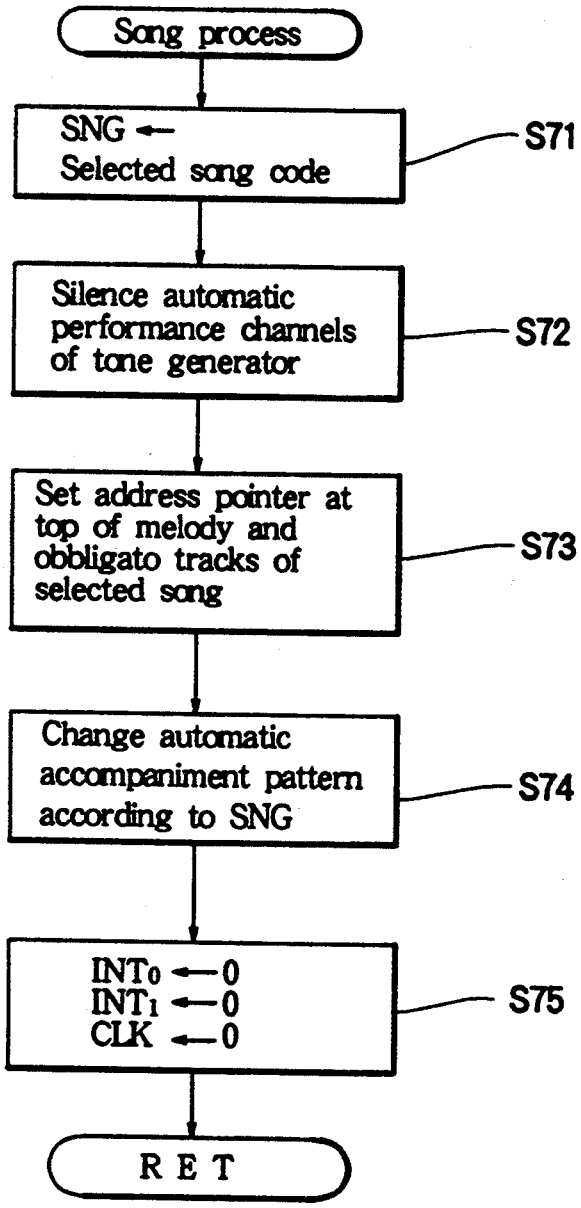
FIG. 6 is a flow chart showing a song process in the embodiment.

The song process of FIG. 6 is initiated when the song selecting switch 31 is actuated to select a desired song. In Step S71, the song code of the selected song is memorized in the register SNG. Then, Step S72 is undertaken to effect a silencing process of all the sound channels of the tone generator 8, used for the automatic performance. The process of Step S72 is directed to discontinue the automatic performance of a previously selected song. Next, Step S73 enables respective address pointers to be set to the top of the melody track and the obbligato track of the newly-selected song. Then, in Step S74, the automatic accompaniment pattern changes according to SNG. Further, in Step S75, the counters $INT_0$, $INT_1$ and CLK are all reset to "0", thereafter returning to the main routine.

Figure 7:
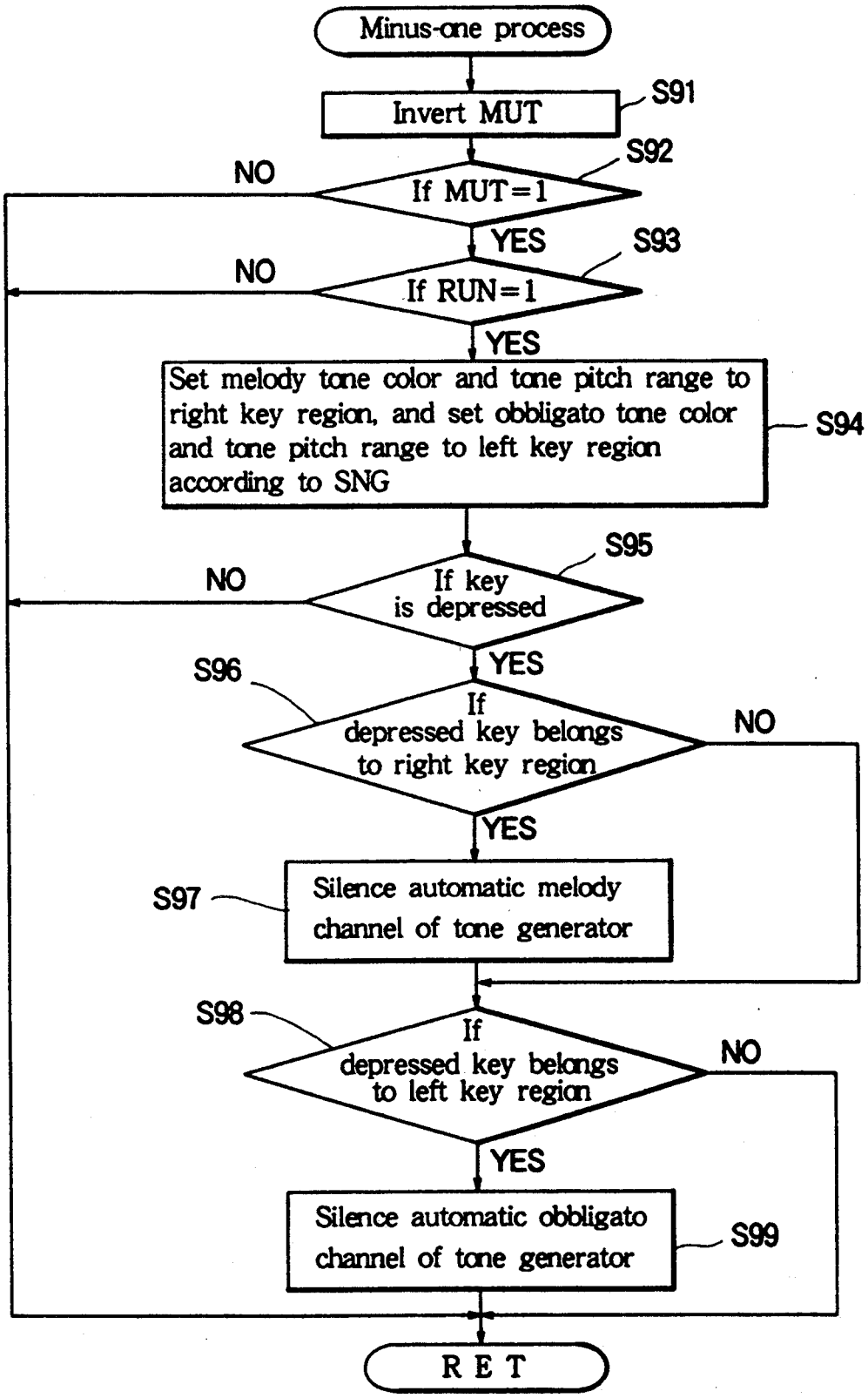
FIG. 7 is a flow chart showing a minus-one process in the embodiment.

In the minus-one process of FIG. 7, the flag MUT is inverted by actuation of the minus-one switch 33 in Step S91. Thereafter, Step S92 if MUT=1 is not held, i.e., if MUT=0, it is necessary to remove the minus-one mode, thereby immediately returning to the main routine. On the other hand, if MUT=1 is held in Step S92, it is necessary to set the minus-one mode so that a subsequent check is made in Step S93 to determine if RUN=1 is set. If RUN=1 is not held in Step S93, it is indicated that the minus-one mode is not effective because the automatic performance mode is not set, thereby immediately returning to the main routine. On the other hand, if RUN=1 is held in Step S93, it is indicated that the minus-one mode is properly set under the automatic performance mode so that subsequent Step S94 occurs to set a melody tone color for the right key region according to the selected song and also to set a tone pitch range. In a similar manner, an obbligato tone color and an obbligato tone pitch range are set for the left key region. Next, Step S95 checks if a certain key is turned on. If no key is depressed, processing returns to the main routine. On the other hand, if a certain key is depressed, Step S96 checks if the depressed key belongs to the right key region. If Step S96 proves to be the right key region, Step S97 silences the automatic melody channel. If Step S96 is not the right key region, Step S98 checks if the depressed key belongs to the left key region. If S98 indicates that the depressed key does not belong to the left key region, processing immediately returns to the main routine. On the other hand, if the left key region is indicated, Step S99 silences the automatic obbligato channel of the tone generator 8, thereafter returning to the main routine. By the above-described minus-one process, whenever the minus-one switch 33 is operated, the minus-one mode is selected or removed alternatively. Further, when the minus-one mode is selected and concurrently a certain key is depressed during the course of the automatic performance, either of the programmed melody and obbligato parts is inhibited and silenced according to the location of the depressed key.

Figure 8:
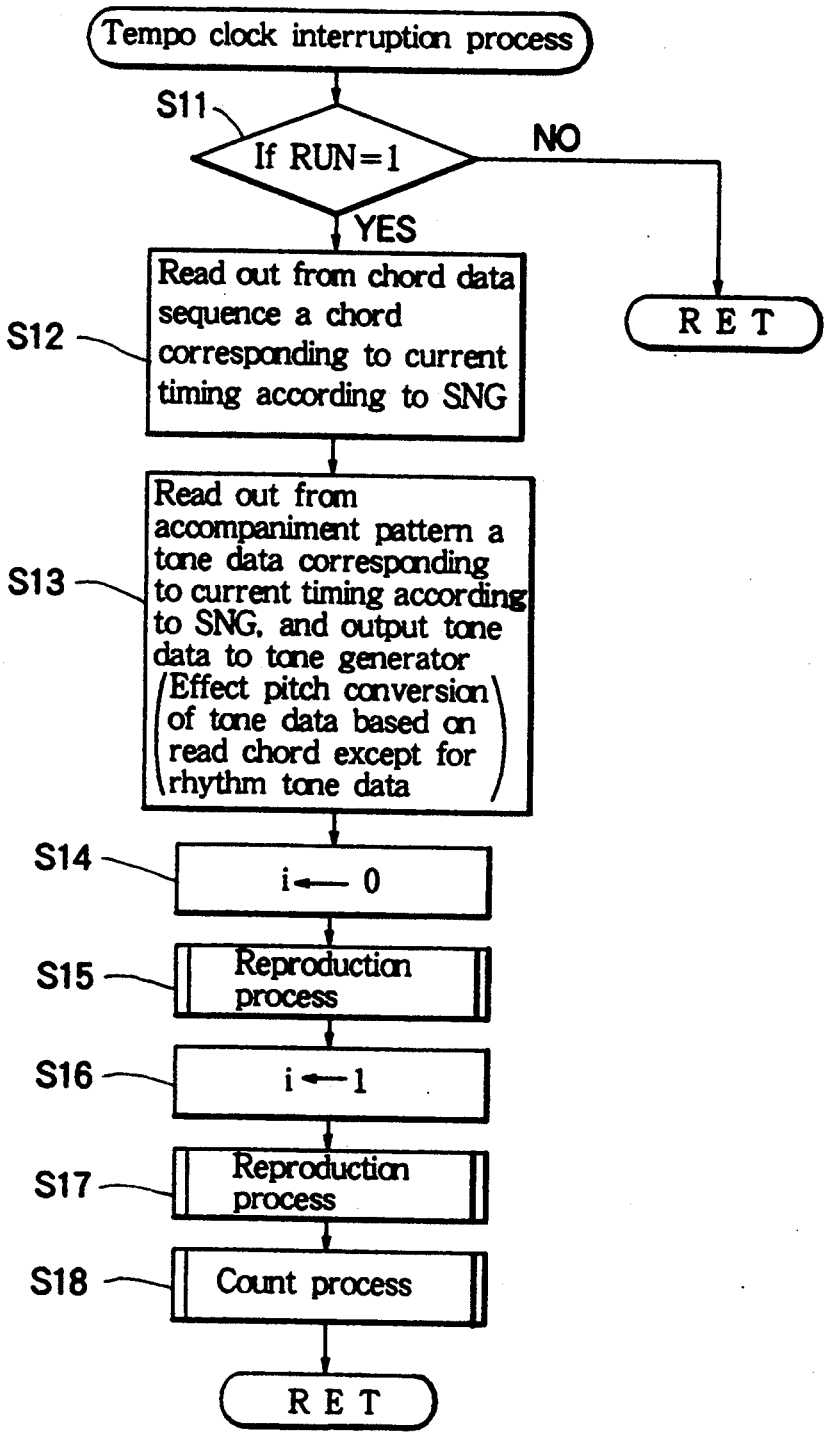
FIG. 8 is a flow chart showing a tempo clock interruption process in the embodiment.

Referring to FIG. 8, the tempo clock interruption process is called every one-eighth beat in response to the tempo clock fed from the tempo clock generating circuit 8. First, Step S11 checks if RUN=1. If RUN=1 is not held, processing immediately returns to the main routine. On the other hand, if RUN=1 is held, Step S12 reads out a chord from the chord data sequence, corresponding to the current timing of the selected song in the automatic performance. Further, Step S13 reads out a tone data from the accompaniment pattern corresponding to the song code SNG at the current timing, and outputs the read tone data to the tone generator 8, thereby advancing to Step S14. Except for rhythm or percussive tone, the tone data is converted into terms of tone pitch according to the read chord, and then fed to the tone generator 8. Next, a variable i is set, in Step S14, with value "0" indicative of the melody track. Then, Step S15 executes the "Reproduction process" shown in FIG. 9. Subsequently, the variable i is updated in Step S16 to the value "1" indicative of the obbligato track. Then, Step S17 is called to execute again the reproduction process of FIG. 9. Lastly, Step S18 again executes the "Count process" of FIG. 11, thereby returning to the main routine. By the above-described tempo clock interruption process, the automatic accompaniment is conducted according to the selected song in Steps S12 and S13. Further, the respective melody and obbligato parts are automatically performed in the reproduction process of Steps S15 and S17.

Figure 9:
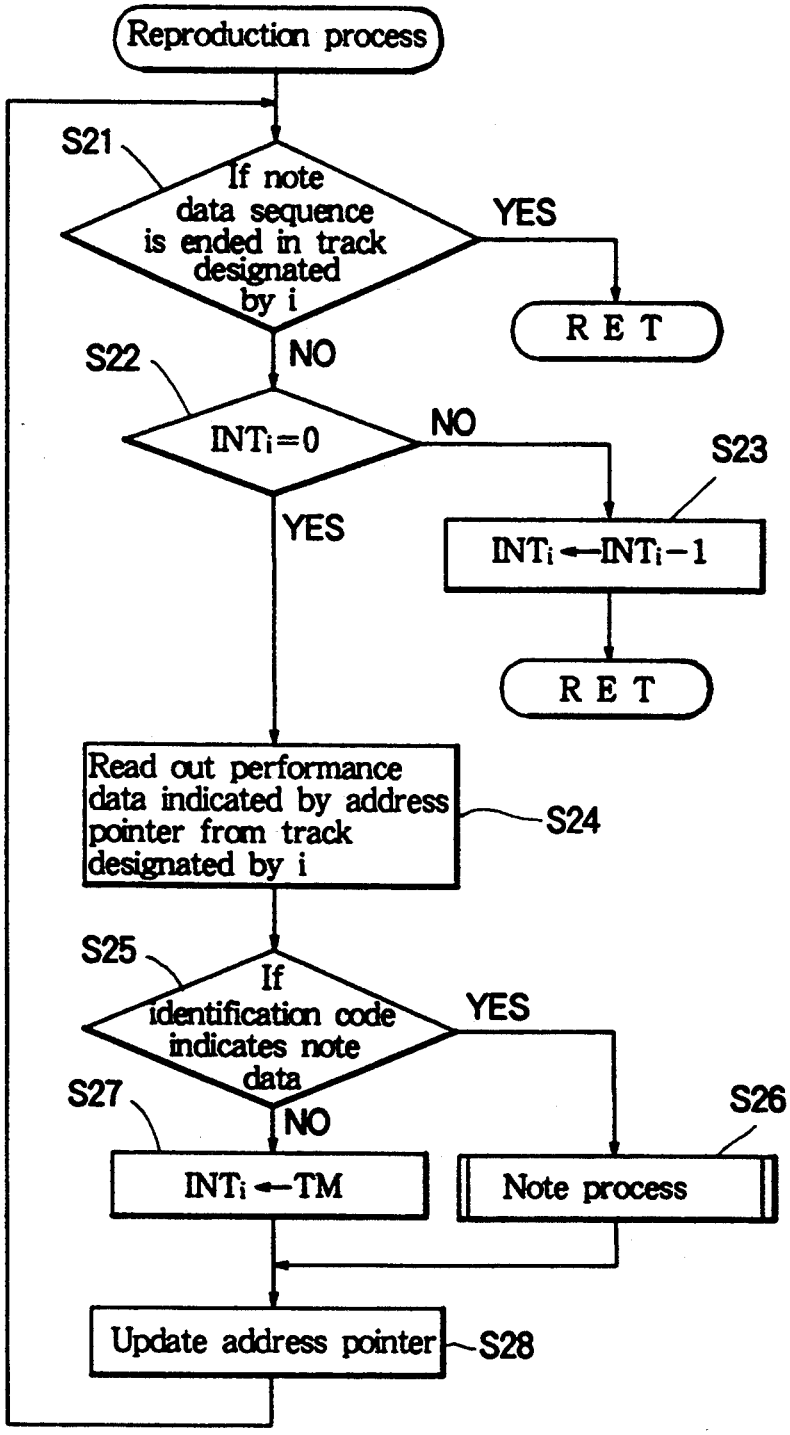
FIG. 9 is a flow chart showing a reproduction process in the embodiment.

In the reproduction process shown in FIG. 9, Step S21 checks data sequence is completed with respect to the track corresponding to the variable i (i.e., the melody part or the obbligato part). If the note data sequence is completed, processing returns immediately to the tempo clock interruption routine. On the other hand, if the note data sequence is not yet completed, a subsequent check is made in Step S22 to see if the counter $INT_i$ reaches value "0". If $INT_i=0$ is not held, the counter $INT_i$ is decremented in Step S23, thereby returning to the tempo clock interruption process. On the other hand, if $INT_i=0$ is held in Step S22, subsequent Step S24 is undertaken to read out a performance data indicated by the address pointer of the particular track corresponding to the variable $_i$. Then, Step S25 checks to whether the identification code contained in the retrieved performance data indicates note data or interval data. If the identification code indicates the note data, Step S26 executes the "Note process" shown in FIG. 10, thereafter advancing to Step S28. On the other hand, if the identification code does not indicate the note data, but indicates the interval data, the time value TM of the retrieved interval data is set to the counter $INT_i$ in Step S27, thereafter advancing to Step S28. In this step, the address pointer is updated, thereby again returning to Step S21 to repeat the subsequent steps. By the above-described reproduction process, when the current timing falls between adjacent note events on either of the melody and obbligato tracks designated by the variable i, the counter $INT_i$ counts the time value TM. When the time value TM lapses, Step S26 effects the note process.

Figure 10:
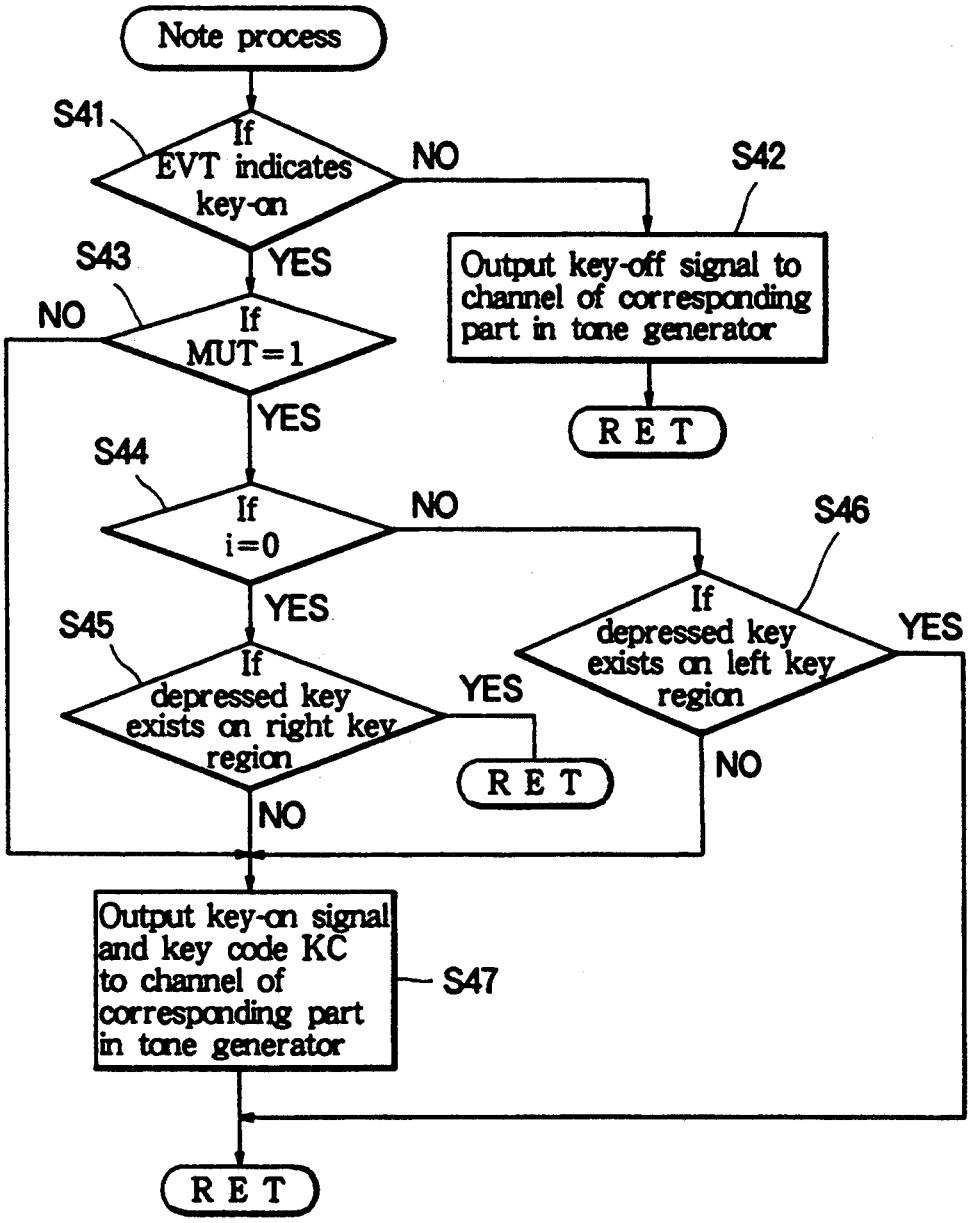
FIG. 10 is a flow chart showing a note process in the embodiment.

In the note process shown in FIG. 10, Step S41 checks if the event code EVT contained in the note data indicates key-on. If the EVT does not indicate key-on, the EVT indicates key-off so that a key-off signal feeds to a particular sound channel of the corresponding part in the tone generator 8, thereafter returning to the reproduction process. On the other hand, if the event code EVT indicates key-on, Step S43 checks as to if MUT=1. If MUT=1 is not held, processing jumps to Step S47. On the other hand, if MUT=1 is held, Step S44 checks if i=0, i.e., if the current processing is associated to the melody part. If i=0 is held in Step S44 to indicate the melody processing, Step 45 checks if there is a certain depressed key-on the right key region. If the right key region contains a depressed key, processing returns immediately to the reproduction process without effecting programmed tone generation of the melody part. On the other hand, if there is no depressed key-on the right key region, processing advances to Step S47. Referring again to Step S44, if i=0 is not held to indicate the obbligato part processing, branched Step S46 checks if there is a depressed key-on the left key region. If the left key region contains an actually depressed key, processing returns immediately to the reproduction process without effecting programmed tone generation of the obbligato part. On the other hand, if there is no depressed key-on the left key region, processing advances to Step S47. In Step S47, a key-on signal and a key code KC contained in the retrieved note data feed to the sound channel of the corresponding part in the tone generator 8 to thereby effect the programmed tone generation, thereafter returning to the reproduction process. By this operation, when the actual key depression is detected only in either of Steps S45 and S46, the processing returns to the reproduction process without effecting the programmed tone generation. Consequently, programmed tone generation of a minus-one part is inhibited or suspended when the manual performance is conducted under the minus-one mode with respect to the same minus-one part.

Figure 11:
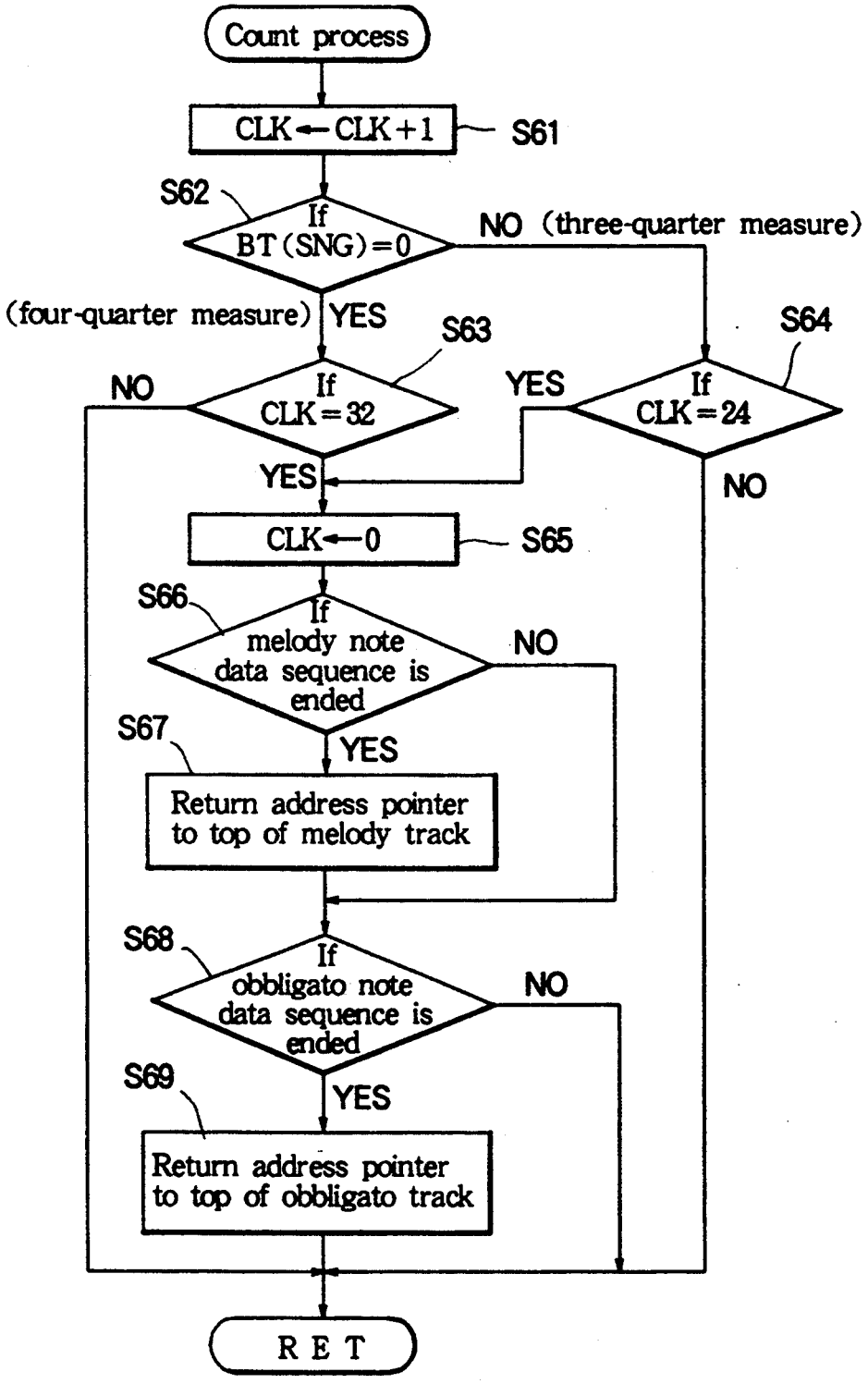
FIG. 11 is a flow chart showing a count process in the embodiment.

In the count process shown in FIG. 11, the counter CLK is incremented in Step S61. Then, Step S62 checks if BT (SNG)=0 is held to determine a time measure of the selected song according to its code SNG. If the condition BT (SNG)=1 is found, three-quarter measure is achieved. Thus, Step S64 checks if the counter CLK reaches "24" which is the full number of clocks contained in the three-quarter measure. On the other hand, if BT (SNG)=0 is held, four-quarter measure is achieved. Thus, Step S63 checks if CLK reaches "32" which is a full number of clocks contained in the four-quarter measure. If the counter CLK=32 is held in Step S63 or CLK=24 is held in Step S64, processing advances to Step S65 in which CLK is reset to "0", thereby proceeding to subsequent Step S66. On the other hand, if the counter CLK does not reach the full clock number of one measure, processing immediately returns to the tempo clock interruption process. Step S66 checks if the note data sequence of the melody track is completed. If it is not completed, processing jumps to Step S68. If it is completed, Step S67 returns the address pointer to the top of the melody track, thereby advancing to Step S68. Step S68 checks if the note data sequence of the obbligato track is completed. If it is not completed, processing returns to the tempo clock interruption process. If it is completed, Step S69 is undertaken to return the address pointer to a top of the obbligato track, thereby returning to the tempo clock interruption process.

According to the invention, as described above, the minus-one mode is established in the automatic performance by operation of the minus-one switch 33. In this mode, when the keyboard 2 is not manipulated, the full automatic performance is carried out, including the melody and obbligato parts. When the right key region is operated, instant tone is generated in response to the key depression while programmed tone of the melody part is not generated and therefore is excluded from the full automatic performance. In the same manner, when the left key region is actuated, instant tone is generated in response to the key depression while programmed tone of the obbligato part is not generated. Accordingly, when the operator plays the keyboard to carry out manual performance in part under the minus-one mode of the automatic performance, the instant tone is generated in a particular part (minus-one part) allotted to the keyboard while the programmed tone is silenced in the same minus-one part so that the operator can accomplish the manual performance of the minus-one part with the automatic accompaniment of the remaining parts. When the operator discontinues manipulation of the keyboard, the programmed tone of the minus-one part is immediately restored to recover the full automatic performance. In this manner, the minus-one function can be switched automatically upon detection of the keyboard operation. This automatic switching of the minus-one function may facilitate practicing of keyboard play, particularly when the player forgets the score.

Generally, in order to emphasize the melody part as compared to the obbligato part in the musical composition, the melody part is set to a higher tone pitch range than that of the obbligato part. Thus in this embodiment, the right key region of a relatively high tone pitch range is allotted with the melody part, and the left key region of a relatively low tone pitch range is allotted with the obbligato part. By such an allotment, a minus-one part to be silenced selectively by the minus-one function can be associated to an adequate section of the input implement (left key region/right key region) suitable for manual performance of that minus-one part. Consequently, by playing the implement associated with a desired part, the minus-one part is automatically selected by the minus-one function, thereby eliminating the additional operation of a function selecting switch.

Though the present embodiment utilizes key region division of the keyboard for detection or discrimination of the melody and obbligato parts, other methods such as different types of implements are discriminated between Musical Instrument Digital Interface (MIDI) channels can be utilized. Further, when regenerating programmed tone of the minus-one part alter stopping the manual keyboard performance, the tone volume may be controlled in a fade-in manner. Similarly, when silencing the programmed tone of the minus-one part after starting the manual keyboard performance, the tone volume may be controlled in a fade-out manner. Moreover, it is expedient to provide a suspending duration at a programmed tone generation timing of the minus-one part during the course of manual performance with the automatic accompaniment under the minus-one mode. By such construction, if a slight delay occurs in manual key touch on the keyboard, duplicate generation of the programmed and instant tones can be avoided. If the manual performance is discontinued over a given interval, the full automatic performance will be initiated without such a suspending duration. Although the performance data is stored in the ROM in the present embodiment, the performance data may be stored in a RAM to effect automatic performance according to the invention. Though the keyboard is utilized as an input implement in the present embodiment, other kinds of input implement may be adopted to automatic switching of the minus-one function upon operation of the implement in the electronic musical instrument. In the process routines of the present embodiment, the right key region is fixedly associated to the melody part and the left key region is fixedly associated to the obbligato part. However, the regions of the keyboard may be associated in a free or flexible manner to channels or tracks of the tone generator. In such a case, a routine for memorizing the association therebetween and steps referring to the added routine may be added.

As described above, according to the invention, the electronic musical instrument has an automatic performance function such as to effect automatic performance of a musical composition composed of plural parts as well as to effect manual performance by means of an input implement such as a keyboard. When the operation of the input implement is detected, programmed tone generation of the automatic performance is partly inhibited for a certain minus-one part which is specifically associated to the input implement. Thus, there can be obtained the automatic minus-one function for the minus-one part by the actuation of the input implement, thereby improving operability and efficiency of the minus-one function in practicing of the electronic musical instrument and so on.

What is claimed is:

1. An electronic musical instrument having an automatic performance function, comprising:

an input implement operable to input manual performance information;

detecting means for detecting operation and non-operation of the input implement;

musical tone generating means receptive of the manual performance information from the input implement for generating instant musical tones accordingly;

automatic performance means for feeding automatic performance information of a given musical composition composed of plural parts to the musical tone generating means so as to generate programmed musical tones accordingly;

allotting means for allotting a particular one of the plural parts of the given musical composition to the input implement; and minus control means operative when the detecting means detects operation of the input implement for controlling the musical tone generating means to inhibit generation of programmed musical tones of the particular part while allowing generation of instant musical tones of the same part, and being operative when the detecting means detects non-operation of the input implement for controlling the musical tone generating means to restart generation of programmed musical tones of the particular part.

2. An electronic musical instrument according to claim 1, wherein the input implement comprises a keyboard having divided key regions, and the allotting means allots melody and obbligato parts of the musical composition separately to different key regions of the divided key regions.

3. An electronic musical instrument according to claim 1, including switch means manually operable for selectively enabling the minus control means to switch between a full automatic performance in which the programmed musical tones are generated for all the parts of the given musical composition and an automatic accompaniment in which the programmed musical tones are generated for remaining plural parts of the given musical composition other than the particular part.

4. An electronic musical instrument according to claim 1, wherein the minus control means includes means operative when the operation of the input implement is discontinued over a given interval of time for restoring generation of the programmed musical tones of the particular part.

5. An electronic musical instrument according to claim 1, wherein the input implement is operable to play plural manual performances corresponding to the plural parts of the given musical composition, and the minus control means includes means for inhibiting sound generation of at least one of the plural parts of the given musical composition.

6. An electronic musical instrument according to claim 5, wherein the input implement comprises a keyboard splittable to plural sections corresponding to the respective plural manual performances.

7. An electronic musical instrument having an automatic performance function and a minus-one play function, comprising:

an input apparatus operable to input manual performance information;

a detection circuit coupled to the input apparatus to detect operation and non-operation of the input apparatus;

a musical tone generating circuit adapted to receive the manual performance information from the input apparatus and generate corresponding musical tones;

an automatic performance circuit coupled to the musical tone generating circuit for providing automatic performance information of a given musical composition composed of a plurality of parts to the musical tone generating circuit to generate programmed musical tones corresponding to the automatic performance information;

a designation circuit to designate a particular one of the plurality of parts of the given musical composition as corresponding to the input apparatus for minus-one play; and a minus-one control circuit that operates when the detection circuit detects operation of the input apparatus to control the musical tone generating circuit to inhibit generation of the programmed musical tones corresponding to the particular one of the plurality of parts designated as corresponding to the input apparatus for minus one play while allowing generation of the corresponding musical tones of the same particular one of the plurality of parts produced from the input apparatus, and that operates when the detection circuit detects non-operation of the input apparatus to control the musical tone generating circuit to restart generation of the programmed musical tones of the particular one of the plurality of parts designated as corresponding to the input apparatus for minus-one play.

8. An electronic musical instrument according to claim 7, wherein the input apparatus includes a keyboard having a plurality of key regions, and the designating circuit designates melody and obbligato parts of the given musical composition to different key regions of the keyboard.

9. An electronic musical instrument according to claim 7, further including a switch circuit that is manually operable to selectively enable the minus-one control circuit to switch between a full automatic performance in which the programmed musical tones are generated for all of the plurality of parts of the given musical composition and an automatic accompaniment in which the programmed musical tones are generated for all remaining plurality of parts of the given musical composition other than the particular one of the plurality of parts.

10. An electronic musical instrument according to claim 7, wherein the minus-one control circuit includes a restoring circuit that is operative when the operation of the input apparatus is discontinued for a predetermined period of time to restore generation of the programmed musical tones of the particular one of the plurality of parts.

11. An electronic musical instrument according to claim 7, wherein the input apparatus is operable to play a plurality of manual performances corresponding to the plurality of parts, and wherein the minus-one control circuit includes means for inhibiting sound generation of at least one of the plurality of parts.

12. An electronic musical instrument according to claim 11 wherein the input apparatus includes a keyboard splittable into a plurality of sections that correspond to the plurality of manual performances.

13. A method of playing an electronic musical instrument having an automatic performance function and a minus-one play function, the method comprising the steps of:

periodically inputting manual performance instructions through an input apparatus;

detecting the presence or absence of manual performance instructions from the input apparatus;

generating musical tones corresponding to the manual performance instructions from the input apparatus;

providing automatic performance information of a given musical composition composed of a plurality of parts to generate programmed musical tones corresponding to the automatic performance information;

designating a particular one of the plurality of parts of the given musical composition as corresponding to the input apparatus for minus-one play;

inhibiting generation of the programmed musical tones corresponding to the particular one of the plurality of parts designated as corresponding to the input apparatus for minus one play while allowing generation of the corresponding musical tones of the same particular one of the plurality of parts produced from the input apparatus when manual performance instructions are detected as being inputted through the input apparatus; and restarting generation of the programmed musical tones of the particular one of the plurality of parts designated as corresponding to the input apparatus for minus-one play when manual performance instructions inputted through the input apparatus have ceased.

14. A method according to claim 13, further including the step of selectively switching between a full automatic performance in which the programmed musical tones are generated for all of the plurality of parts of the given musical composition and an automatic accompaniment in which the programmed musical tones are generated for all remaining plurality of parts other than the particular one of the plurality of parts.

15. A method according to claim 13, further comprising the step of restoring the generation of the programmed musical tones of the particular one of the plurality of parts after the manual performance instructions have ceased for a predetermined period of time.

* * * * *